US008726603B2

(12) United States Patent
Huang

(10) Patent No.: US 8,726,603 B2
(45) Date of Patent: May 20, 2014

(54) BOARD ASSEMBLY

(75) Inventor: Huanwen Huang, Foshan (CN)

(73) Assignee: Hong Kong Mei Li Sheng Flooring Co., Limited, Kowloon (HK)

( * ) Notice: Subject to any disclaimer, the term of this patent is extended or adjusted under 35 U.S.C. 154(b) by 0 days.

(21) Appl. No.: 13/201,332

(22) PCT Filed: Jun. 1, 2011

(86) PCT No.: PCT/CN2011/075085

§ 371 (c)(1),
(2), (4) Date: Aug. 31, 2012

(87) PCT Pub. No.: WO2011/153916

PCT Pub. Date: Dec. 15, 2011

(65) Prior Publication Data

US 2012/0317911 A1 Dec. 20, 2012

(30) Foreign Application Priority Data

Jun. 9, 2010 (CN) ..... 2010 1 0203493
Aug. 27, 2010 (CN) ..... PCT/CN2010/001304

(51) Int. Cl.
*E04F 15/02* (2006.01)

(52) U.S. Cl.
USPC ..... 52/591.1

(58) Field of Classification Search
USPC ..... 52/592.1, 591.1, 589.1
See application file for complete search history.

(56) References Cited

U.S. PATENT DOCUMENTS 357,144 A * 2/1887 Buttler ..... 52/592.2
2,900,676 A * 8/1959 Kahr ..... 52/592.1
3,310,919 A * 3/1967 Bue et al. ..... 52/127.11
3,667,153 A * 6/1972 Christiansen ..... 446/124
5,136,823 A * 8/1992 Pellegrino ..... 52/539
5,458,953 A 10/1995 Wang et al.
6,006,486 A 12/1999 Moriau et al.
6,287,706 B1 9/2001 Simpson et al.
7,114,298 B2 10/2006 Kotler
7,137,229 B2 * 11/2006 Pervan ..... 52/313

(Continued)

FOREIGN PATENT DOCUMENTS

CN 2175275 8/1994
CN 2389959 8/2000

(Continued)

OTHER PUBLICATIONS

International Application No. PCT/CN2011/075085 International Search Report dated Sep. 15, 2011.

*Primary Examiner* — Christine T Cajilig
(74) *Attorney, Agent, or Firm* — Banner & Witcoff, Ltd.

(57) ABSTRACT

A floor board assembly convenient to lay is characterized in that, in one embodiment, it comprises a frame, a filler board and an upper material with the frame and filler board affixed to the underside of the upper material. The frame includes latch tongues that extend outwardly from the lower side edges of the frame, and the tongues have locking projections that fit into recesses arranged just inside the periphery of the underside of the frame. The tongues and intervening spaces (with locking bars behind them) are space along the periphery of the board, such that any side of one board may be joined to any side of a similarly configured board. The upper material may be selected from a variety of materials, including LVT (luxury vinyl tile), carpet, high pressure laminate or other decorative material. The filler board may be selected to accomplish reduced cost, and/or improved acoustics. In other embodiments, a frame and/or upper material may be absent. The floor board assembly requires a lower manufacture cost and lower equipment investment, has stable quality, versatility and ease of installation.

26 Claims, 9 Drawing Sheets

(56) References Cited

U.S. PATENT DOCUMENTS

| | | | | |
|---|---|---|---|---|
| 7,155,871 | B1 | 1/2007 | Stone et al. | |
| 7,322,159 | B2 | 1/2008 | Stone et al. | |
| 7,543,417 | B2 * | 6/2009 | McIntosh et al. | 52/589.1 |
| 7,607,265 | B2 * | 10/2009 | Curry et al. | 52/181 |
| 7,779,602 | B2 | 8/2010 | Collison | |
| 8,245,478 | B2 * | 8/2012 | Bergelin et al. | 52/592.1 |
| 8,276,342 | B2 * | 10/2012 | Martensson | 52/582.1 |
| 8,316,606 | B2 * | 11/2012 | Siewert et al. | 52/483.1 |
| 8,359,807 | B2 * | 1/2013 | Kang | 52/592.1 |
| 2001/0034992 | A1 * | 11/2001 | Pletzer et al. | 52/581 |
| 2002/0108343 | A1 * | 8/2002 | Knauseder | 52/592.1 |
| 2003/0009971 | A1 * | 1/2003 | Palmberg | 52/578 |
| 2003/0177728 | A1 | 9/2003 | Ku | |
| 2005/0028475 | A1 | 2/2005 | Barlow et al. | |
| 2006/0230701 | A1 * | 10/2006 | Pepa | 52/592.1 |
| 2006/0254182 | A1 * | 11/2006 | Cerasi et al. | 52/592.1 |
| 2007/0051063 | A1 * | 3/2007 | Sabater et al. | 52/592.1 |
| 2007/0214741 | A1 * | 9/2007 | Llorens Miravet | 52/592.1 |
| 2008/0302044 | A1 * | 12/2008 | Johansson | 52/403.1 |
| 2009/0038253 | A1 * | 2/2009 | Martensson | 52/582.1 |
| 2009/0193748 | A1 * | 8/2009 | Boo et al. | 52/589.1 |
| 2012/0144770 | A1 * | 6/2012 | McIntosh et al. | 52/582.1 |

FOREIGN PATENT DOCUMENTS

| | | | |
|---|---|---|---|
| CN | 2394985 | | 9/2000 |
| CN | 2491539 | | 5/2002 |
| CN | 2491539 | Y | 5/2002 |
| CN | 2499489 | | 7/2002 |
| CN | 2505415 | | 8/2002 |
| CN | 2591128 | | 12/2003 |
| CN | 2639430 | | 9/2004 |
| CN | 2642913 | | 9/2004 |
| CN | 2918621 | | 7/2007 |
| CN | 101148941 | | 3/2008 |
| CN | 101148941 | A | 3/2008 |
| CN | 201078071 | | 6/2008 |
| CN | 101718142 | | 6/2010 |
| CN | 101718142 | A | 6/2010 |
| CN | 201495736 | | 6/2010 |
| CN | 101775891 | | 7/2010 |
| CN | 201581597 | | 9/2010 |
| CN | 101881076 | | 11/2010 |
| CN | 101881076 | A | 11/2010 |
| CN | 201704926 | | 1/2011 |
| CN | 201704926 | U | 1/2011 |
| EP | 0543583 | | 5/1993 |
| EP | 0603310 | B1 | 12/1996 |
| EP | 0528194 | B1 | 9/1998 |
| GB | 857025 | | 12/1960 |
| JP | 2001227139 | | 8/2001 |
| JP | 2007146603 | | 6/2007 |
| UA | 98444 | | 1/2006 |
| WO | 2007044293 | | 4/2007 |
| WO | 2008088239 | | 7/2008 |
| WO | 2008088239 | A1 | 7/2008 |
| WO | 2011075933 | | 6/2011 |
| WO | 2011075933 | A1 | 6/2011 |

* cited by examiner

BOARD ASSEMBLY

TECHNICAL FIELD

The present invention is related to boards, such as flooring boards, wall boards and ceiling boards.

BACKGROUND

Board used in the construction of floors, walls and ceilings are composed of a wide variety of materials, and designed to be joined in wide variety of ways. Floor boards are often made of composite material including multiple layers of different materials. Floor boards are also joined to one another by a wide variety of structures and techniques, including standard tongue and groove connections and more complex and easy-to-use systems that employ adhesives and adhesive tape, snapping connections incorporated into board edges, angling board with interlocking edges, and overlapping edges. Many of the edges are specially designed to achieve objectives relating to strength, minimum visibility of the joint, prevention of ingress of water and dirt, durability, low cost of production and many others objectives.

In the case of flooring, there are two systems of vinyl floating floors that are currently the available in the market. These are systems in which locking tongues and locking grooves are machined into the edges of the sheet comprising the flooring board, much like typical laminate flooring of the type described in U.S. Pat. No. 6,006,486 and patents related thereto. Problems with this system include the fact that in order to have sufficient room to form a machined vinyl locking tongue and locking groove on opposite edges of the board, the board is required to be quite thick, and vinyl itself is a relatively flexible and deformable material, not well-suited for creating a strong mechanical connection. Another system relies on adhesive strips applied to the underside of adjacent panels. This system is described in U.S. Pat. Nos. 7,155,871 and 7,322,159. However, these systems do not provide a mechanical connection between boards, they cannot be readily disassembled, and are difficult to install, because once a board is placed on the joining adhesive strip, it is difficult to re-locate.

SUMMARY OF THE INVENTIONS

Boards that embody the inventions described herein reduce the manufacturing costs and the equipment investment, and also result in an assembly that has stable quality, is easy to assemble, is more versatile and is less susceptible to water damage.

A first embodiment of the board embodying the inventions described herein comprises a frame, a filler board disposed inside the board frame, and an upper decorative material, wherein the lower surface of the decorative material is affixed to the upper surface of the frame and upper surface of the filler board, preferably by an adhesive. The board may be square or rectangular. The board frame may be comprised of frame units having respective ends mutually connected by a dovetail (or other) connection, or may be a single continuous strip, and in either case the frame defines a central opening for receiving the filler board. The frame is provided with latch tongues and catches. The latch tongues extend outwardly from the edges of the frame, and the tongues have upwardly extending protrusions that fit into a recess formed on the underside of the frame of an adjacent board. The board is formed by the assembly of the frame and the filler board to the underside of the upper decorative material by use of an appropriate adhesive or other secure connection. The decorative material can be chosen based on need, and may be a sheet of luxury vinyl tile, carpet, a more rigid material such as high pressure laminate, or any other flooring material capable of being adhered or affixed to a filler board, which makes the floor board assembly more versatile in use.

The latch tongues are spaced apart from one another along the perimeter of the frame. Recesses are disposed in the underside of the frame at locations corresponding to the spaces between the tongues. The tongues along one side are staggered relative to the tongues on an opposite side of the frame. Similarly, the recesses on one side of the frame are staggered relative to the recesses on the opposite side of the frame. In use, two of the boards are connected with each other by inserting the tips of the tongues of a first board into recesses of a second board that has tongues and recesses that are configured in a manner that is substantially the same at that of the first board. In this manner, the latch tongues and recesses on one side a board can be engaged with the recesses and tongues at any other side of a similarly configured board. In the context of flooring, with the connection system embodying the inventions described herein, boards can be assembled in a variety of configurations to form a floating floor, and the floor can be assembled reliably without the need of adhesives or nails. Furthermore, the system is adapted to be made of materials that can readily withstand exposure to water, unlike many laminate flooring systems that include fiberboard.

In a second embodiment, there is provided a four-sided board having a plurality of latch tongues on each side extending outwardly from the board, each latch tongue having an upwardly extending projection; the board having at least one locking bar located on its underside for engaging the upwardly extending projection of at least one of the latch tongues; wherein the latch tongues along each side of the frame are located at positions that are staggered with respect to the locations of latch tongues on an opposite side of the frame; each latch tongue on the board having a width, and each of the latch tongues being separated from an adjacent latch tongue on the same side by a minimum space, the minimum space between latch tongues on the board being at least as wide as the widest latch tongue on a board, such that any side of a board may be connected to any side of another board of the same configuration. The board may be square or rectangular. In an embodiment, the board may be a single, integrally formed unit. In an embodiment, the latch tongues may be been made separately from the board and affixed thereto. In a preferred embodiment, the latch tongues are integrally formed with the board. The four-sided board may comprise a single four-sided piece of material, e.g. plastic or wooden material, with the latch tongues extending outwardly from the four-sided piece of material, and optionally integrally formed therewith. However, in a preferred embodiment, the board comprises a frame defining a space. In an embodiment struts and/or a mesh may be disposed within the space of the frame, the struts and/or mesh optionally being integrally formed with one or more sides of the frame. In an embodiment, a filler board is disposed within the frame. In an embodiment, the board further comprises an upper material having an exposed upper face and an underside. The filler board may be disposed within the space defined by the frame. The underside of the upper material may be attached to an upper surface of the frame, and the underside of the upper material may be attached to an upper surface of the filler board. The latch tongues preferably extend outwardly from the frame. The locking bar may have a length, when measured in the direction along a side of the board, greater than at least one tongue on the board. Optionally, a locking bar extends along the entire length of the space between the tongues to which is closest disposed. The locking bar may form part of at least one recess formed in the underside of the frame for engaging at least one latch tongue. The configuration of the latches, the components with which they engage, such as the recess or locking bar, and the materials of any of the components of the board in this second embodiment may be as described herein for the first embodiment or as described below in relation to the embodiments described in relation to the figures or appended claims.

The materials that may be used in the board are described below. This will be applicable to all possible embodiments of the board described herein, unless otherwise stated.

The board may comprise a plastic. If the board comprises a frame, the frame may comprise a plastic. If the board comprises a filler board within the frame, as described herein, the filler board may comprise a plastic. In an embodiment, both the frame and filler board comprise a plastic, the plastic of the frame and filler board being the same as or different from one another.

Preferably, one or more, preferably all, latch tongues on the floor board are integrally formed with the board, and optionally the latch tongues and base board comprise a plastic. If a frame is present, one or more, preferably all, latch tongues are preferably integrally formed with the frame on which they are disposed, and optionally the latch tongues and the frame comprise a plastic.

If a frame is present, it may be a four sided-frame, wherein each side of the frame is integrally formed with the two sides of the frame with which it is connected, and optionally each side of the frame comprises a plastic, which may be as described herein. If a frame is present, the aperture defined by the four sides of the frame may optionally have a mesh material therein, which may be in contact with and integrally formed with the sides of the frame. If a frame is present, the aperture defined by the four sides of the frame may optionally have a filler board as described therein.

The frame may comprise a thermoplastic or thermosetting plastic. Preferably, the frame comprises a thermoplastic material. Preferably, the frame comprises a non-crystalline thermoplastic material. Such non-crystalline thermoplastic materials are sometimes termed amorphous plastics. Preferably, the frame comprises one or more plastics selected from polycarbonate, polystyrene, high-impact polystyrene, styrene copolymers, polyamide (PA), acrylonitrile-butadiene-styrene (ABS), vinyl chloride copolymers, and polyvinyl chloride. These plastics are typically non-crystalline plastics. Such plastics have been found to provide a suitable balance of properties for ensuring that, when joining two adjacent floor boards together by sliding them in the same plane, the tongues to flex sufficiently and then interconnect with the recess(es) and/or locking bar(s), but when joined, the connection made is sufficiently rigid for general normal use that the floor boards do not come apart.

Preferably, the frame comprises acrylonitrile-butadiene-styrene (ABS) and/or polystyrene (PS). The ABS may comprise a mixture of acrylonitrile-styrene copolymer (SAN) and acrylonitrile-butadiene copolymer. In a preferred embodiment, ABS includes, but is not limited to, a material including polybutadiene rubber particles in an acrylonitrile matrix. Such a material can be made by mixing styrene and acrylonitrile monomers to a polybutadiene latex, and warming the mixture (e.g. to a temperature of 50° C. or more) if necessary, to allow dissolution of the monomers; the styrene and acrylonitrile monomers are then polymerised. This typically results in a mixture of polybutadiene, polybutadiene grafted with acrylonitrile and styrene, and styrene-acrylonitrile copolymer.

The frame may comprise high-impact polystyrene (HIPS), sometimes termed toughened polystyrene. High-impact polystyrene includes, but is not limited to, a mixture of a rubber (e.g. styrene-butadiene rubber) and polystyrene. High-impact polystyrene may be made, for example, by mixing a rubber material (e.g. styrene-butadiene rubber), with styrene, then polymerising the styrene monomer. This typically results in a mixture of the rubber material, the polystyrene, and a graft polymer in which styrene chains are attached to the backbone of the rubber polymer. Mechanical properties of High Impact Polystyrene may further be improved by blending with Styrene-Butadiene-Styrene (SBS) copolymers, or by grafting of maleic anhydride (HIPS-g-MA). High Impact Polystyrene and ABS are described in, for example Plastics Materials, Seventh Edition, authored by J. A. Brydson, and published by Butterworth Heinemann, which is incorporated herein by reference in its entirety.

Preferably, the base board, and, if present, the frame, comprises a plastic having a Young's modulus of 0.5 to 10 GPa, optionally 1 to 7 GPa, optionally 1 to 5 GPa, optionally, 1.8 to 4 GPa, optionally 2 to 3.5 GPa, as measured using ASTM D638-10 test, also identifiable under the digital object identifier (DOI) number: 10.1520/D0638-10. A skilled person can commercially obtain or make plastic materials having such a property.

If the base board comprises a filler board within the frame, the filler board may comprise a material different from the frame. The filler board may comprise a material that is less dense than the frame. The filler board may comprise a material that forms a porous or a non-porous sheet. The filler board may optionally include a material comprising cellular voids, e.g. a foamed material. The foamed material may include open and/or closed pores. The filler board may comprise a fibrous material, e.g. a fabric material that may comprise fibres that are woven, knitted or non-woven, such as a felt material. The filler board preferably comprises a thermoplastic. The frame may comprise a first plastic and the filler board may comprise a second plastic. If the frame comprises a first plastic, the filler board may comprise a second plastic, wherein the second plastic is less dense than the first plastic. The compression modulus of the second plastic is optionally no more and/or no less than 30%, optionally 20%, optionally 10%, optionally 5%, of the value of the compression modulus of the first plastic. The compression moduli of the first and second plastics can be measured using an appropriate ASTM test, for example: ASTM D1621-10 Standard Test Method for Compressive Properties Of Rigid Cellular Plastics, or ASTM D695-10 Standard Test Method for Compressive Properties of Rigid Plastics.

The filler board may comprise a sheet of foamed or non-foamed plastic material.

The filler board may comprise one or more materials selected from plastic, rubber and fibrous cellulosic material, e.g. paper or card. The filler board preferably comprises a plastic selected from polyvinylchloride (PVC), vinylchloride copolymers, ethylene-vinylacetate copolymers (EVA), and a polyolefin, e.g. polyethylene or polypropylene or ethylene-propylene copolymers. The filler board preferably comprises a plastic selected from polyvinylchloride (PVC), vinylchloride copolymers and ethylene-vinylacetate copolymers (EVA). The filler board may optionally include a plastic material comprising cellular voids, e.g. a foamed plastic material. The foamed plastic material may include open and/or closed pores. The filler board may have a thickness that is the same as, more than or less than the thickness of the frame within which it is disposed, the thickness of the filler board being the resting thickness of the filler board, if compressible.

In an embodiment, the frame comprises a plastic selected from plastics selected from polycarbonate, polystyrene, acrylonitrile-butadiene-styrene (ABS), and polyvinyl chloride, and the filler board comprises a plastic selected from polyvinylchloride (PVC), vinylchloride copolymers, ethylene-vinylacetate copolymers (EVA), and a polyolefin, e.g. polyethylene or polypropylene or ethylene-propylene copolymers. In an embodiment, the frame comprises a plastic selected from polystyrene, optionally high impact polystyrene, and acrylonitrile-butadiene-styrene (ABS), and the filler board comprises a material selected from polyvinylchloride (PVC) and ethylene-vinylacetate copolymers (EVA).

The materials described above for the filler board have been found to provide sufficient support for the overlying upper material, and avoid the overlying upper material sagging in the aperture defined by the frame under normal use, while giving the board a certain degree of flexibility, allowing it to conform, over time, to uneven surfaces on which the board may be laid. They have also been found to have advantageous in the acoustic properties of the board.

The upper material may comprise any suitable material. If the board is for use as a flooring board, the material should ideally be suitable for walking upon in normal use. The upper material may comprise, for example, veneer, cork, vinyl, linoleum, stone, metal, wood, carpet, ceramic material and the like. The upper material may comprise a sheet having a printed and/or embossed pattern thereon. The printed and/or embossed pattern may show a pattern such as wood grain or that of a polished stone surface, such as marble.

In an embodiment, the upper material comprises one or more sheets of plastic material. If the upper material comprises more than one sheet of plastic material, the sheets of plastic material may be put together using any known technique, such as a technique selected from extrusion, calendering, solvent welding, ultrasonic welding and adhesive assisted lamination. The one or more sheets of plastic material may comprise any suitable plastic, including, but not limited to, a plastic selected from polyvinylchloride (PVC), a polyolefin, polyurethane and urethane-acrylate co-polymers. The polyolefin may be selected from polypropylene, ethylene-propylene copolymers and polyethylene. The upper material may comprise a sheet comprising plastic having a printed pattern thereon. The sheet comprising plastic having a printed pattern thereon may have one or more overlying layers thereon, which are preferably sufficiently transparent that the printed pattern can be seen through the one or more overlying layers.

Optionally, if the upper material comprises a sheet having a printed pattern thereon, one or more further sheets may be disposed between the base board, which may comprise the frame and filler board as described herein, and the sheet having a printed pattern thereon. The one or more further sheets may be made of the same or different type of plastic as the sheet having the printed pattern thereon. The one or more further sheets, the printed sheet, and optionally any overlying layer thereon may all optionally comprise polyvinylchloride (PVC) or a vinylchloride copolymer.

The upper material preferably comprises a plurality of sheets comprising plastic material, preferably PVC or a vinylchloride copolymer. The upper material preferably comprises at least two, optionally at least three, optionally at least four sheets comprising plastic material, preferably PVC or a vinylchloride copolymer. The total thickness of the plurality of sheets of the upper material is preferably 5 mm or less, optionally 4 mm or less, optionally 3 mm or less, optionally 2 mm or less. The total thickness of the plurality of sheets of the upper material is preferably 0.5 mm or more, preferably 1 mm or more.

The plastic of any of the components described herein may further comprise one or more organic or inorganic additives known in the art, and/or one or more intermediate support or carrying layers, including reinforcement in the form of glass fibers, or other non-woven systems, or by using cross directional polymer layers.

The base board, for example the frame and filler board, may be adhered to the upper material using any known adhesive. Suitable adhesives are commercially available and can be selected by the skilled person, depending on the nature of the materials to be adhered. Suitable adhesives include, but are not limited to, hot-melt adhesives, contact adhesives, multi-component adhesives. Multi-component adhesives, including, but not limited to adhesives having a combination of components selected from (i) polyester resin and polyurethane resin; (ii) a polyol and a polyurethane resin, and (iii) an acrylic polymer and a polyurethane resin. In an embodiment, the adhesive may be selected from cyanoacrylate adhesive and a neoprene adhesive, e.g. a water-based neoprene adhesive.

Compared to existing techniques, the present invention has a lower manufacture cost, lower equipment investment, stable quality and is versatile in use.

DRAWINGS

DESCRIPTION OF THE EMBODIMENTS

The inventions set forth herein are described with reference to the above-described drawings and some specific examples or embodiments. There are three embodiments described, and they are merely exemplary of the many variations that will be apparent to those skilled in the art. They include a first embodiment depicted in FIGS. 1 through 4, a second embodiment depicted in FIGS. 5 through 11, and a third embodiment depicted in FIG. 12.

Figure 1:
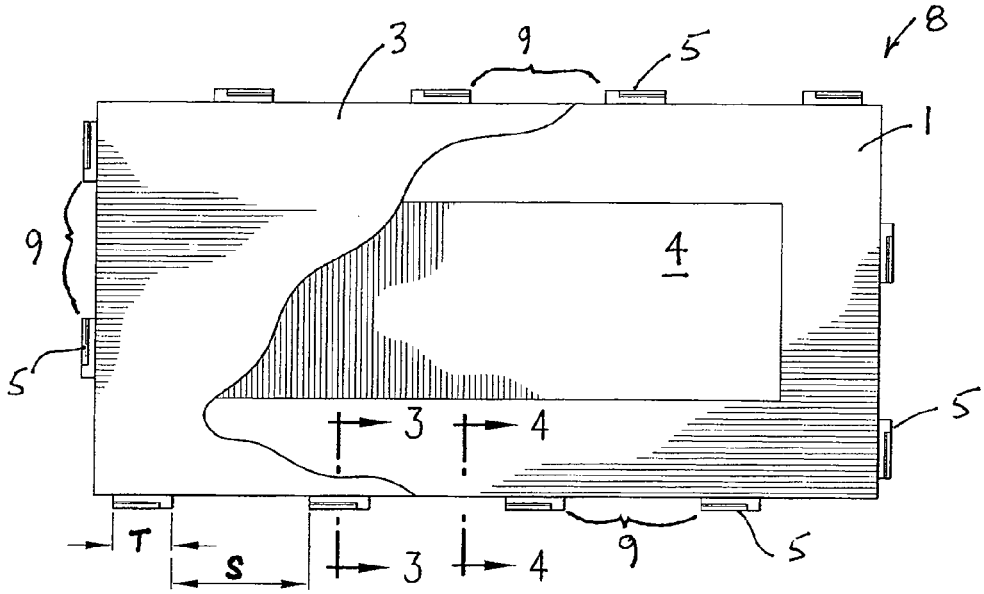
FIG. 1 is a schematic top plan view of one embodiment of the present invention with the top layer of material cut away.

FIG. 1 is a top plan view, somewhat schematic in nature, showing the general construction of a floor board 8, including a frame 1 and a filler board 4, the top surfaces of which are both affixed (in this instance by an adhesive) to the underside of an upper material 3. The filler board 4 fits within the frame 1 and has a thickness that is generally equal to the thickness of the frame 1, but the relative thicknesses of these components may be different depending on the relative compressibility of the materials used to form them, and may be varied to achieve a particular appearance, particularly if the upper material 3 is flexible enough to conform to a thickness differential in the underlying components, i.e., the frame 1 and filler panel or board 4.

Figure 2:
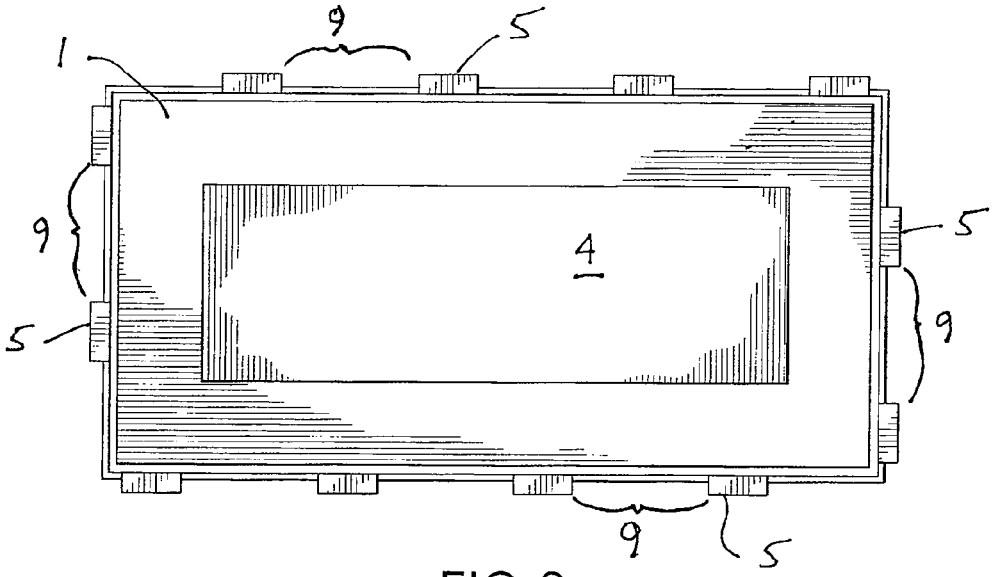
FIG. 2 is a schematic bottom plan view of the embodiment shown in FIG. 1.

FIG. 2 is a bottom plan view of the board 8 shown in FIG. 1. In FIGS. 1 and 2, tongues 5 extend laterally from the lower edges of the frame 1, and the tongues 5 are separated by spaces 9. The frame 1 in FIGS. 1 and 2 is a single piece of injection molded high impact polystyrene, but the frame could be comprised of two or more pieces of such injection molded plastic that are connected at endpoints by, for example, by two L-shaped sections joined by a simple dovetail connection, or otherwise affixed. In an alternative embodiment, the frame may be replaced with a single piece of material, absent of a recess, e.g. a sheet of plastic or other material, having the tongues preferably integrally formed therewith and recesses preferably integrally formed therein. The tongues 5 (in this instance) each have a width T and the tongues 5 are separated from at least one adjacent tongue 5 by a distance S. In the example of FIGS. 1 and 2 the ratio of S to T is greater than 2:1. The spaces 9 have dimension S, which should be at least as large as (and preferably at least twice the width of) the width T, so that the tongue 5 of a first board may fit easily between the tongues of a second board to which it is intended to be joined. The position of the tongues on one side are staggered or offset with respect to the positions of the tongues on an opposite side. In this instance, the tongue 5 on one side is aligned with the center of the space on an opposite side of the same board. This staggered placement of tongues 5 and spaces 9 is characteristic of both the long and short sides of the oblong board 8.

Figure 3:
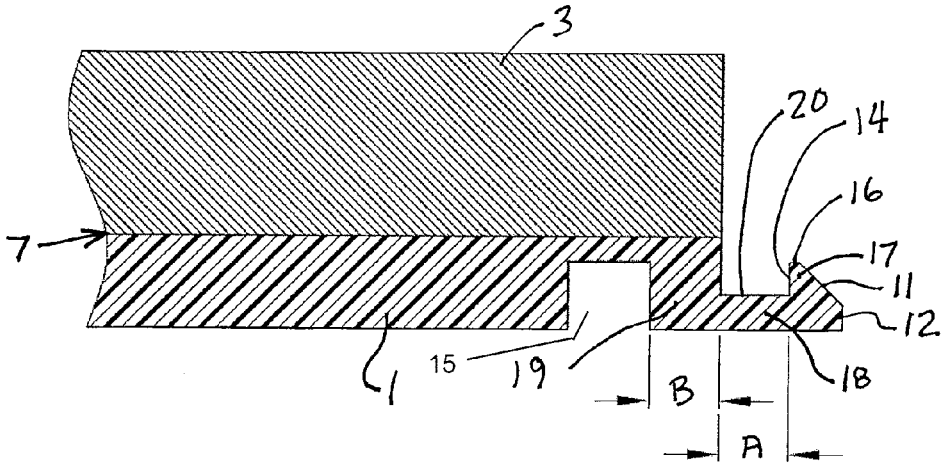
FIG. 3 is a cross-sectional view taken along the line 3-3 of FIG. 1.
Figure 4:
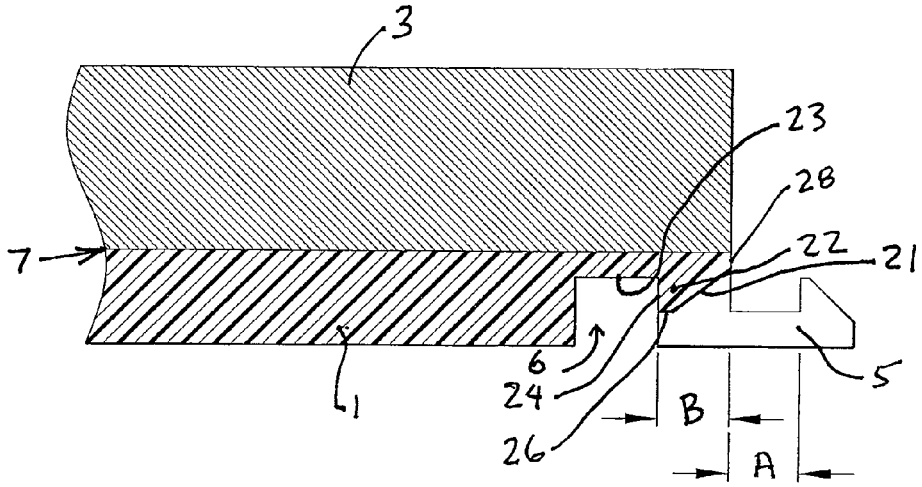
FIG. 4 is a cross-sectional view taken along the line 4-4 of FIG. 1.

FIGS. 3 and 4 are enlarged cross-sectional views of the edges of the board shown in FIGS. 1 and 2. FIG. 3 is view taken along line 3-3 of FIG. 1, and shows a cross-section of a tongue 5. The intermediate section 18 of the tongue 5 extends from a base 19. An upwardly extending projection 17 is disposed on the distal side of the tongue 5. The projection 17 is generally triangular in shape, and a beveled nose 11 faces generally outwardly and upwardly away from the board 8. The tongue 5 has a generally vertical tip surface 12 adjacent to lower edge of the beveled nose 11. The projection 17 includes a generally flat top surface 16 from which a generally vertical locking surface 14 extends downwardly to a generally flat bearing surface 20 on top of the intermediate section 18. A channel 15 is disposed inwardly of the base 19 of the tongue 5. The channel 15 is a continuation of the recess 6 shown in FIG. 4.

FIG. 4 is a cross-section through the edge of a board 8 at a location between the tongues 5, i.e., at the location of a space 9. FIG. 4 shows a locking bar 22 having a beveled surface 21 that faces downwardly and outwardly from the frame 1. The locking bar 22 has a generally vertical locking surface 24 which forms one boundary of the recess 6. The locking surface 24 is adapted to engage the generally flat locking surface 20 on the projection 17 of a tongue 5, when adjacent boards are joined. It should be noted that while surfaces 14 and 24 are shown herein as being generally vertical, they could be at an angle (either the same angle or different angles), and the orientation of those locking surfaces may be varied to make it easier or more difficult to disengage joined panels or boards. The recess 6 has a top surface (or ceiling) 23 adapted to about the top flat surface 16 of the projection 17 on the tip of a tongue when adjacent boards are joined.

In FIGS. 3 and 4, dimensions A and B corresponds to the length of the intermediate section 18, and the distance from the locking surface 14 to the outer face 28 of the edge of the board 8, respectively. Dimension B is the transverse cross-sectional length of the locking bar 22 that is received by the space defined by dimension A. The relationship between A and B maybe varied along with other factors such as the frictional properties of the materials used, and the extent to which flexible or pliable materials are used, both in the manufacture of the frame 1 and in the manufacture of the upper material 3, as discussed below in connection with FIG. 12. Depending on the importance of having a gap-free joint and possibly on the importance of having panels or boards that are able to be displaced and/or disassembled dimension A may be greater than, equal to, or less than B.

FIGS. 5 through 11 show components of a second embodiment. In describing the second embodiment, three-digit reference numerals are used. Where structures similar to the first embodiment are present in the second embodiment, the tens digit and units digit of the reference numerals are chosen to correspond to the two digit reference numerals used to describe the first embodiment.

Figure 5:
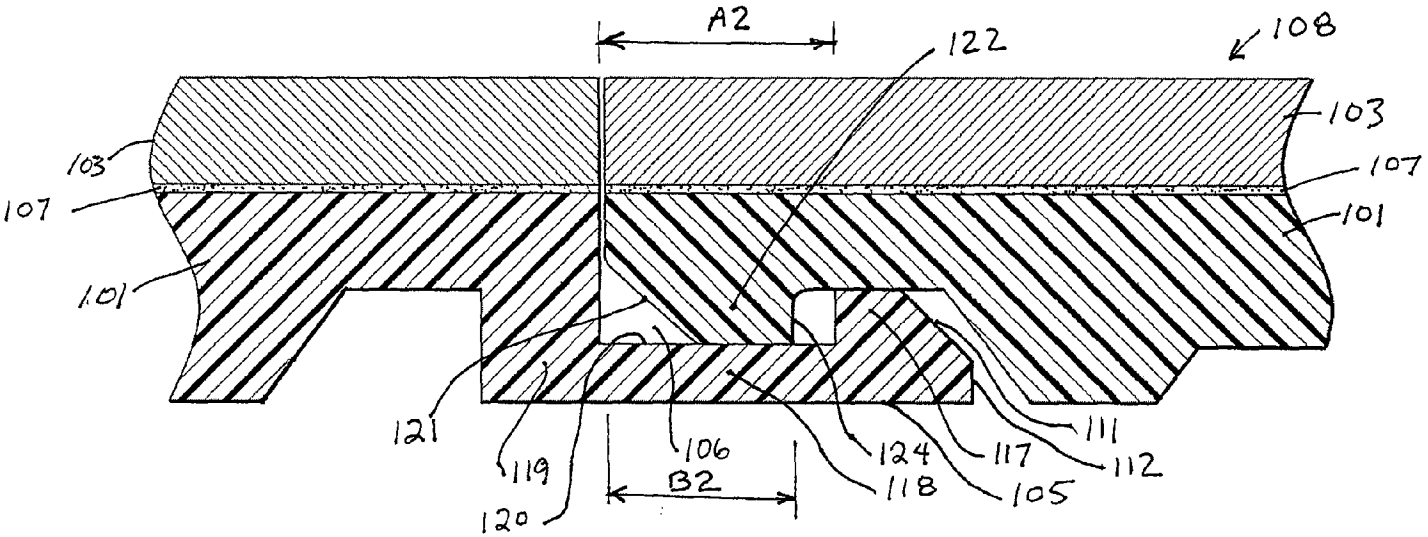
FIG. 5 is a cross-sectional view of a second embodiment showing the joined edges of two boards.
Figure 6:
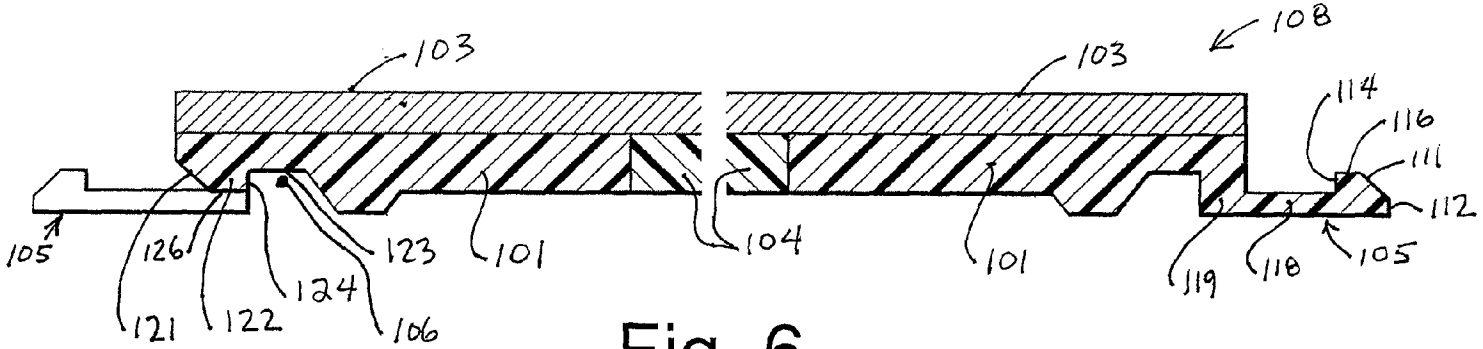
FIG. 6 is a lateral cross-sectional view the embodiment of a single board of the kind shown in FIG. 5 with the center of the board truncated to enlarge the edges.

FIG. 5 is a cross-sectional view of two boards 108 in a joined configuration, and FIG. 6 is a truncated cross-sectional view of a board 108 corresponding to the boards shown in FIG. 5. As with the first embodiment, the boards 108 include an upper material 103 (in this instance a luxury vinyl sheet with an embossed upper decorative layer) affixed by an adhesive layer 107 (shown in FIG. 5, but too thin to be shown in FIG. 6) to the top surface of the frame 101 and to the top surface of the filler board 104 (shown in FIG. 6 in truncated form). A locking projection 117 on the distal side of the tongue 105 of the board 108 on the left side in FIG. 5 is disposed in recess 106 formed on the underside of the board 108 on the right in FIG. 5. The locking projection 117 extends upwardly from the distal end of the tongue 105, and has a generally vertical locking surface 114 that is adapted to abut and make contact with a generally vertical locking surface 124 on the inwardly facing wall of the recess 106. The tongue 105 has a beveled nose 111 below which is located a blunt tip defined by a flat generally vertical surface 112. The distal side of the tongue 105 is joined to the base 119 by an intermediate section 118 having a flat upper surface 120, which contacts and abuts a lower surface 126 of the locking bar 122. The locking bar 122 has downwardly and outwardly beveled guide surface 121 that, during a slide-snapping assembly, co-acts with the beveled nose 111 to facilitate joining of the board by lateral displacement of the boards from a substantially co-planar position.

The upper material 103 in the second embodiment is preferably a decorative vinyl flooring sheet such as, but not limited to, what is known in the art as LVT (luxury vinyl tile) sheet. Such a vinyl flooring sheet preferably has an embossed upper layer made of a vinyl chloride-containing polymer or a PVC-free floor covering vinyl polymer material and eventually equipped with a protective coat of a polymer adhering to said vinyl chloride-containing polymer or PVC-free floor covering vinyl polymer material.

Examples of suitable vinyl chloride-containing polymers for the vinyl flooring sheet of the upper material 103 include any such vinyl polymer having the desirable combination of properties like flexibility, resistance to walking, ease of cleaning and the like. These include homopolymers and copolymers of vinyl chloride.

Examples of suitable PVC-free floor covering vinyl polymer materials for the vinyl flooring sheet of the upper material 103 include, but are not limited to, polyethylene, polypropylene, ethylene-vinyl acetate copolymers of low density or very low density having the desirable combination of properties like flexibility, resistance to walking, ease of cleaning and the like. These include ethylene-vinyl acetate copolymers with a melt index between 0.3 and 8.0 g/10 min (190° C./2.16 according to DIN 53 73) as described for instance in EP-0 528 194-B.

Other floor covering vinyl polymer materials are described in U.S. Pat. No. 6,287,706, U.S. Pat. No. 5,458,953, EP 0603,310-B and EP 0528,194-B, the content of which is hereby incorporated by reference.

The protective coat of a polymer adhesive to said vinyl chloride-containing polymer or PVC-free floor covering vinyl polymer material may be made of any coating material having the desirable combination of properties like glass transition temperature, elongation at break, and tensile strength, such as, but not limited to, polyurethane or polyacrylate lacquers.

The vinyl chloride-containing polymer or PVC-free floor covering vinyl polymer material may further comprise one or more organic or inorganic additives known in the art, and/or one or more intermediate support or carrying layers made of PVC or PVC-free polymer materials, including reinforcement in the form of glass fibers, or other non-woven systems, or by using cross directional layers of PVC or PVC-free polymer materials for stabilisation, and a bottom surface layer made of PVC or PVC-free polymer materials. The filler board 104 is also a vinyl sheet, but instead of having a decorative upper layer, the upper and lower faces of the filler board 104 have the same material as the bottom surface of the upper material 103.

The adhesive 107 is Scotch-Weld™ 30, a water based neoprene adhesive, available from 3M which is known to adhere well to both high impact polystyrene (the plastic of which the frame 101 is made) and PVC (the material of which underside of vinyl sheet 103 is made). While two different types of connecting methods (such as adhesives) could be used, i.e., one joining underside the upper sheet 103 to the upper surface of the frame 101, and another joining the underside the upper sheet 103 to the upper surface of the filler board 104, it is preferable that a single connection method, i.e., a single adhesive compatible with all three joined surfaces (the underside of the vinyl upper material 103, the top of the frame and the top of the vinyl filler board). By selecting a filler board 104 such that it has an upper surface that is the same as the lower surface of the upper material 103, the choice of adhesive may be simplified, since compatibility between that common surface and the material of the frame 101 is the primary compatibility requirement. If the material of filler board is chosen such that its upper surface does not match that of the bottom of the upper material or the top surface of the frame, then an adhesive must be selected such that it is compatible with all three materials used (i.e., the bottom of the upper material, the top of the filler layer an the top of the frame), or two different connecting methods (such as two different adhesives) may be required, one to join the upper material to the filler board, and another to join the upper material to the frame.

While dimension A2 (the lateral dimension of the intermediate section 118 of the tongue 105 in FIG. 6) is shown as being substantially larger than the dimension B2 (the lateral dimension of the locking bar 122), FIG. 5 is intended to be schematic, and should not be treated an engineering drawing. Furthermore, as discussed above, the dimensions A2 and B2, and other dimensions, such as the extent to which the top material 103 may extend beyond the perimeter of the frame 101, can be varied, such that a joint made with boards 108 can be made more or less tight, depending on particular design objectives. Depending on factors such as whether the boards 108 are made such that the upper material is laterally larger than the frame, whether the frame material has flexibility, and whether it is required that the boards be displaceable along their joined edges, dimension A2 may be less than, equal to or greater than dimension B2.

Figure 7:
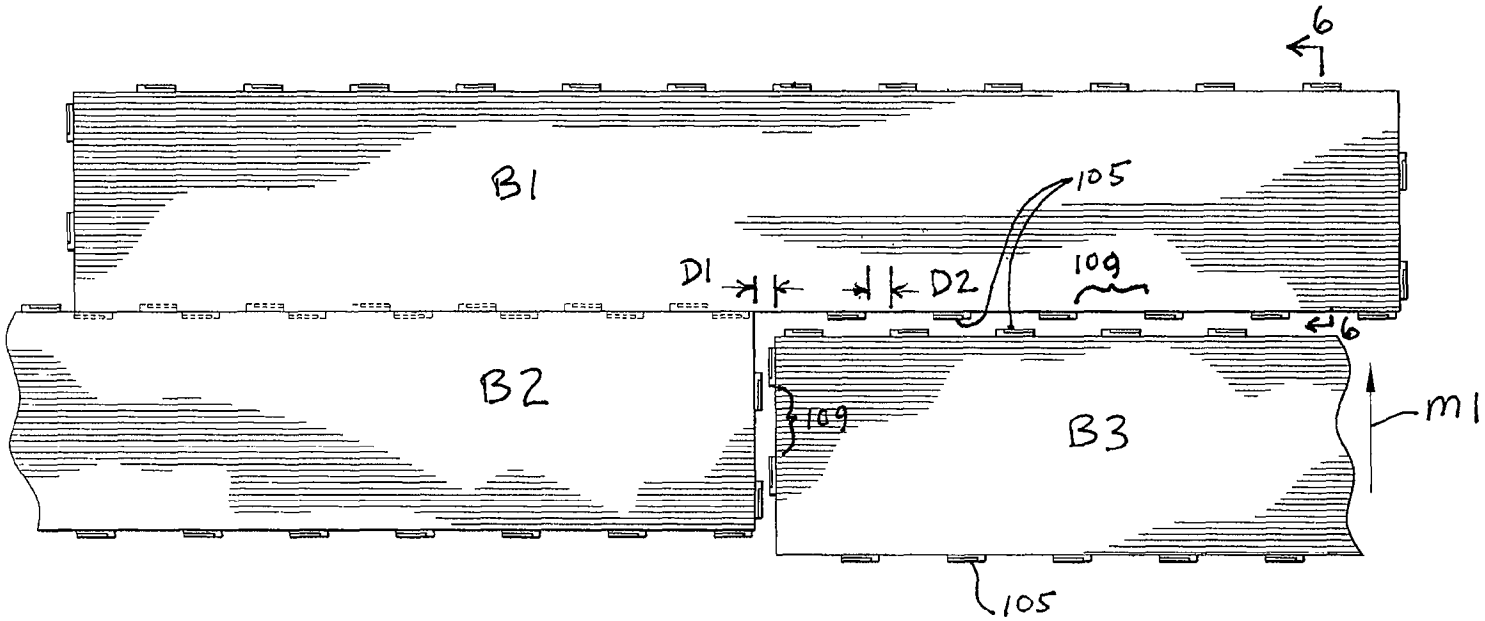
FIGS. 7-9 are schematic plan views of the steps by which boards of the second embodiment may be assembled.
Figure 8:
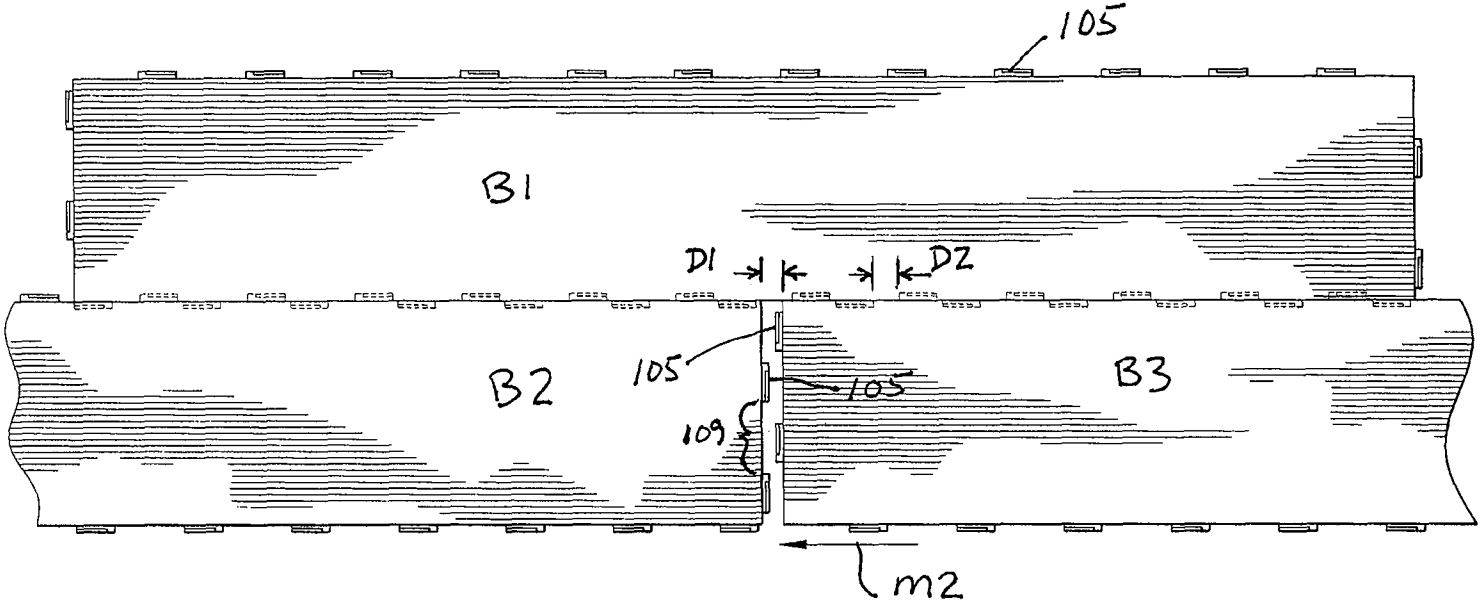
Figure 9:
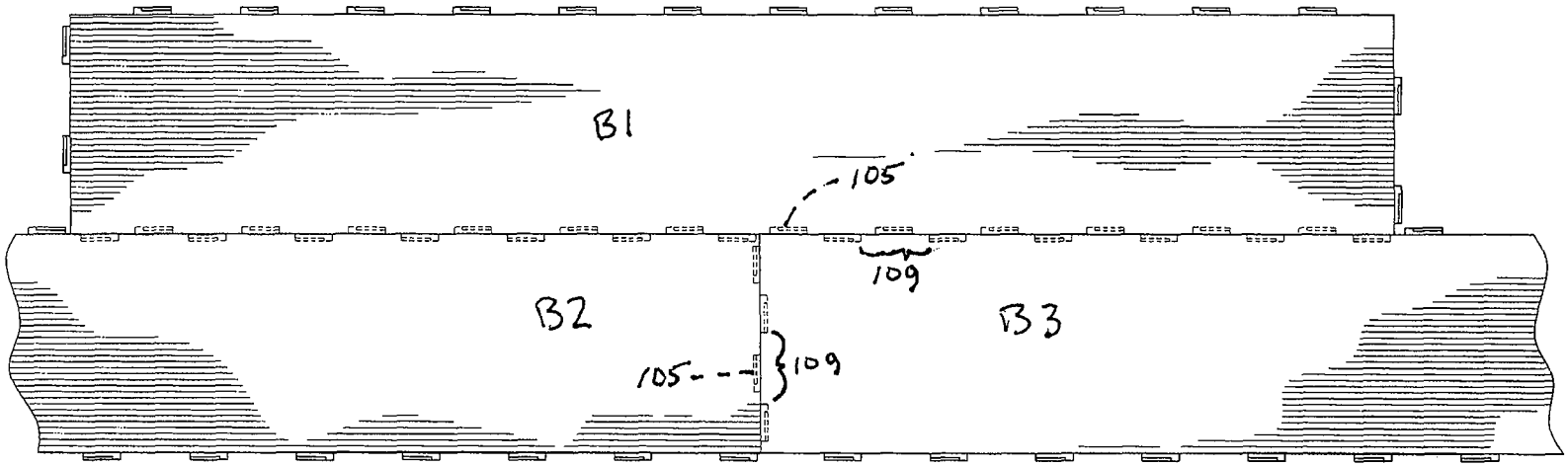

FIGS. 7, 8 and 9 show a series of positions of three boards, B1, B2 and B3 during an assembly of three boards in which boards B1 and B2 are first joined such that portions of their respective long edges are connected. This connection may be made by angling, i.e., by lifting the distal side of board B2 and inserting several of the tongues 105 along a portion of one long side of board B1 into the spaces 109 between several tongues 105 along a portion of the proximal long side of board B1, and then lowering the distal side of board B2 while pressing board B2 toward board B1. A portion of the long side of board B3 may be joined to another portion of the same side of board B1 in a similar manner, but should be done with the short sides of boards B2 and B3 near to each other as shown in FIG. 7, so that a small amount of displacement of board B3 toward board B2 will cause their short sides to engage one another by a snapping action (See FIG. 9). The snapping engagement of short sides of boards B2 and B3 is made possible by two features: 1) the relationship of the size of the spaces 109 to the width of the tongues 105, which results in dimension D2 being at least as large as D1, as shown in FIGS. 7 and 8, and 2) the offset nature of the tongues 105 and spaces 109 on the opposing short sides of a board 108 (i.e., the right hand short side of board B2 and the left hand short side of board B3), as shown in FIGS. 7 through 9.

While the long sides of boards B2 and B3 may be angled into engagement with board B1, it should be noted that those connections can also be accomplished by a slide-snapping operation, i.e., for example by aligning the tongues 105 on a portion of the long side of board B2 (and/or B3) with spaces 109 between tongues on board B1, and pushing the boards toward each other while they are generally co-planar.

In FIG. 7 the arrow M1 is intended to show the first direction of movement of board B3 in a two-step assembly of board B3 into a floor covering using boards 108. As noted above board B3 may be angled or snapped into engagement with board B1. In FIG. 8, arrow M2 is intended to show the snapping engagement of the left-hand short side of board B3 with the right-hand short side of board B2. Because the long side of board B3 was previously connected to the long side of board B1, board B3 cannot be lifted and angled into engagement with board B2, at least from the position shown in FIG. 8. It should be noted that, it is possible to form a floor covering with boards 108 by first connecting the short sides of boards B2 and B3 with an angling technique, followed by a movement of board B3 toward board B1 and slide-snapping the long sides of boards B3 and B1 into engagement.

FIGS. 10 through 14 show components of a third embodiment. In describing the third embodiment, three-digit reference numerals in the two hundreds are used. Where structures similar to the first two embodiment are present in the third embodiment, the tens digit and units digit of the reference numerals are chosen to correspond to the two digit reference numerals used to describe the first and second embodiments.

Figure 10:
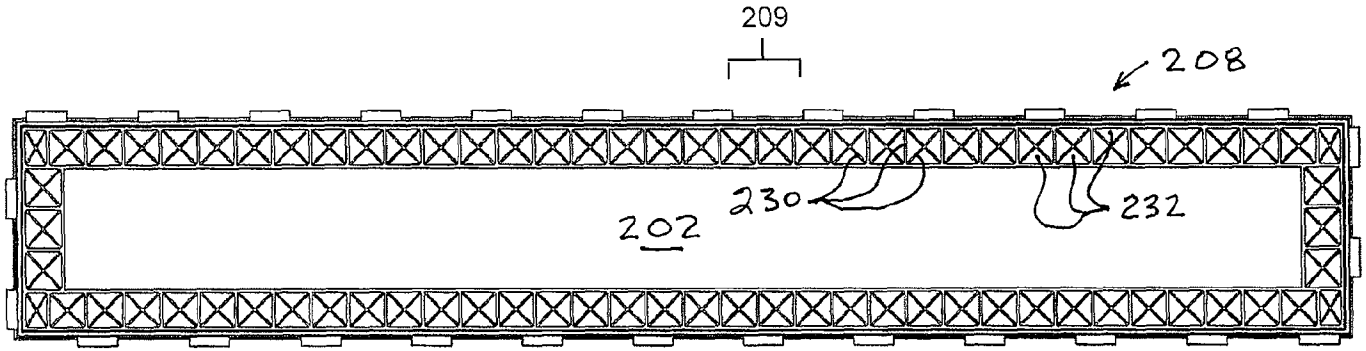
FIG. 10 is a bottom plan view of the frame alone of the board that is the shown in FIGS. 5 through 9.

FIGS. 10-14 depict a third embodiment of boards 208 made in accordance with the inventions describe herein. FIG. 10 is a bottom plan view of a board 208. Ribs 230 and voids 232 are formed on the underside of the frame 201. The rib and void arrangement of the underside of the frame serves two purposes: 1) to reduce the amount of face-to-face contact (and resulting transmission of sound) between the underside of the frame 201 and a supporting sub-floor, and 2) to reduce the amount of material (in this case a high-impact polystyrene) used to injection mold the frame 201.

Figure 11:
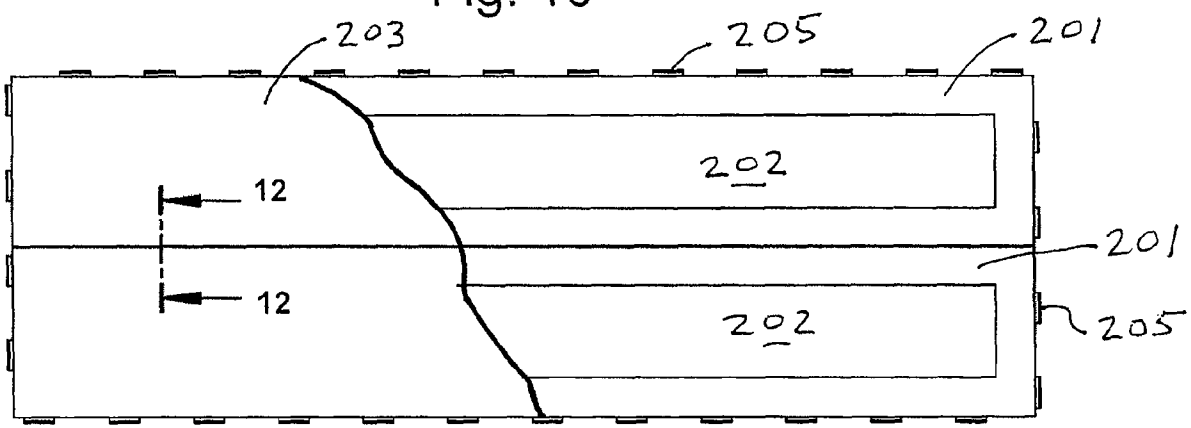
FIG. 11 is a top plan view of the two joined frames of the type shown in FIG. 10.

As with the first and second embodiments, tongues 205 extend outwardly from a lower edge of the frame 201, and those tongues are spaced from each other by spaces 209. FIG. 11 is a top plan view of two board 208 joined together with their long sides joined along their full lengths.

Figure 12:
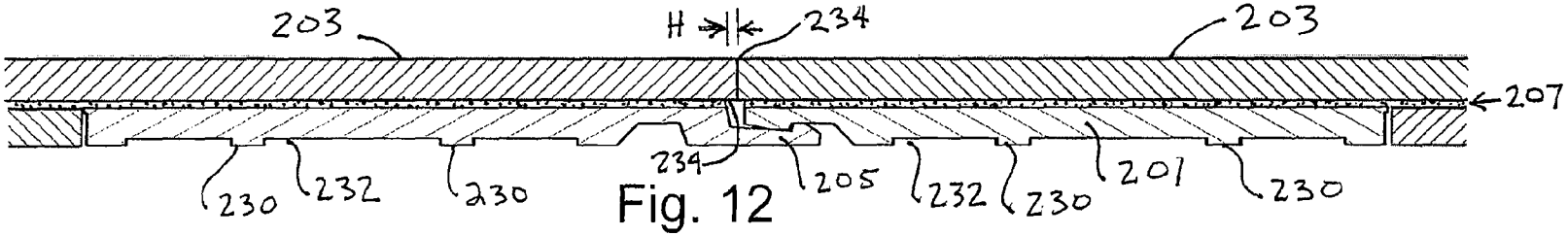
FIG. 12 is a cross-sectional view of two joined board made in accordance with a third embodiment.

FIG. 12 is a cross-sectional view of the joined sides of two boards 208 taken along line 12-12 in FIG. 11. In this third embodiment the top material 203 (which is a luxury vinyl sheet, but may be another material, preferably but not necessarily a flexible material, such as carpet) is sized to be slightly larger than the lateral dimensions of the frame 201, which forms overhanging lips 234, which when the boards are joined press against each another (forming a tight fit and/or a seal at the upper surface of the boards 208) as the locking surface 220 of the projection 217 contacts and presses against the locking surface 224 of the recess 206.

Figure 13:
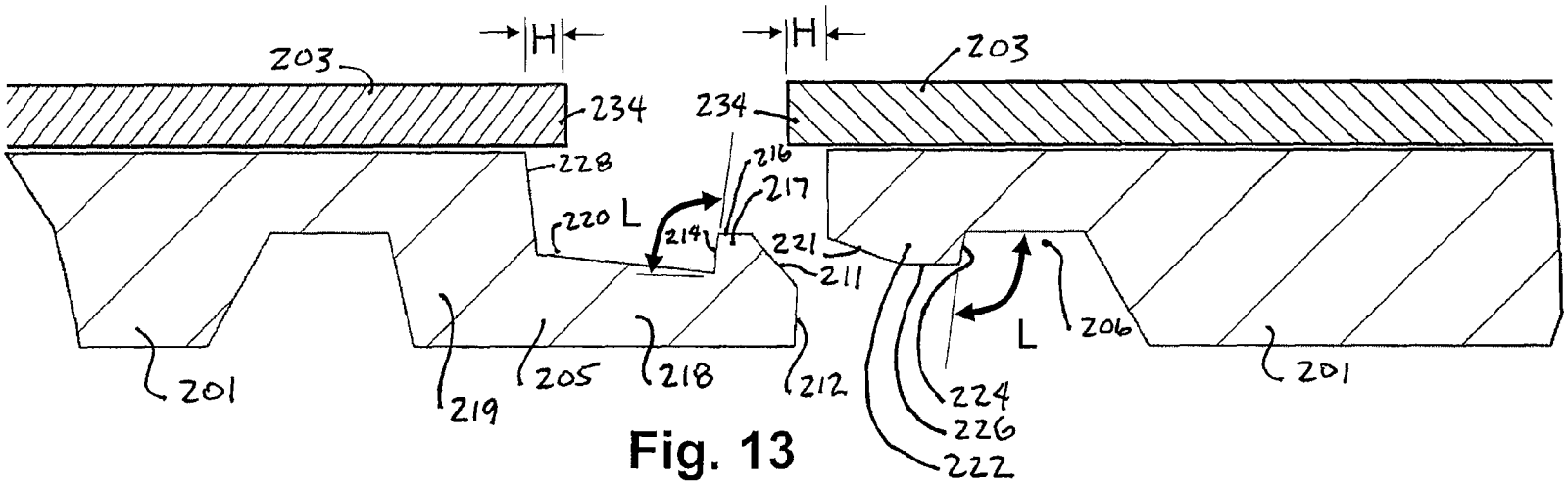
FIG. 13 is a cross-sectional view of two adjacent board made in accordance with a third embodiment prior to their being joined.
Figure 14:
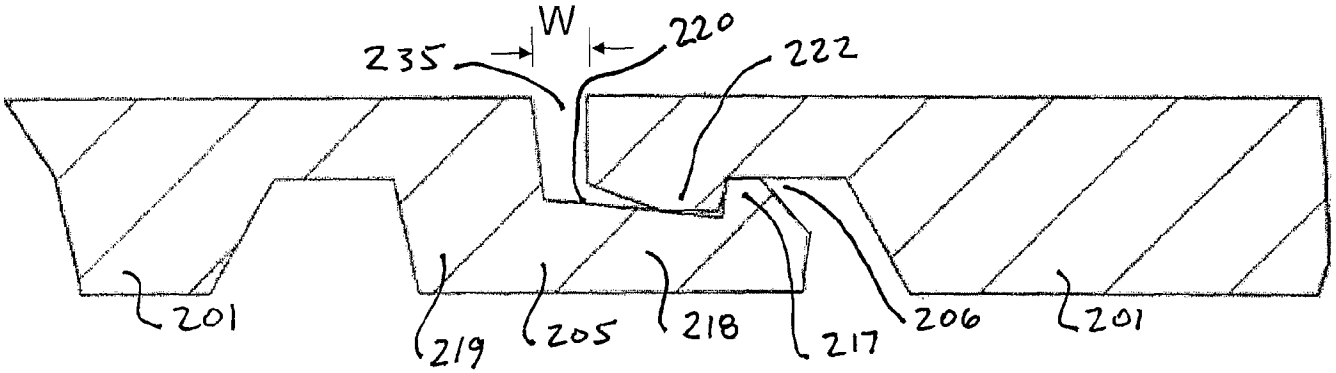
FIG. 14 is a cross-sectional view of two joined frames (without an attached upper material) made in accordance with a third embodiment.

FIGS. 13 and 14 are enlarged cross-sectional views of the sides of two boards and two frames, respectively, at the location of a tongue 205 and a space 209 (and locking bar 222 and recess 206). In FIG. 13, the locking surface 214 of the tongue 205 is slightly upwardly facing and is at an angle (L) of about 102 degrees with respect to horizontal. The locking surface 224 on the locking bar 222 is disposed slightly downwardly facing and is also disposed at an angle (L) of about 102 degrees with respect to horizontal. In FIG. 14 (showing only frame sections, i.e., without an upper material), the locking surfaces 214 and 224 are in contact with each other. The locking bar 222 rests against the upper surface 220 of the intermediate section 218 of the tongue 205. As with the first embodiment, the tongue 205 extends from a tongue base 219. Above the tongue base 219 and the intermediate section 218, the boards 205 have a face 228 that extends from the upper edge of the frame 201 down to the tongue 205.

FIG. 14 shows an opening 235 of width W between the upper faces of joined frames when the locking surfaces 214 and 224 are in contact. FIG. 13 shows an overhanging portion 234 of the upper material 203 extending outwardly beyond the edge of the upper faces of the frames 201. The lateral dimension H of the overhanging portions 234 is preferably greater than half of the dimension W, so that when the boards 208 are connected, the overhanging portions 234 of joined boards will be compressed horizontally and deform to cover the opening 235. Depending on the compressibility and deformability of the upper material 203, the dimension H may be only slightly greater than half of the dimension W. Depending on the rigidity and hardness of the upper material 203 selected, the dimension H may be less than half of W, equal to half of W or greater than half of W. Materials that are readily deformable, such as vinyl sheets or carpet, the dimension H of the overhanging portion 234 may be substantially greater than half of W. However, with more rigid, harder or more brittle materials, the dimension H of the overhanging portion 234 may be less than or equal to half of W. A factor in determining the proper dimension H, is whether there is flexibility of the frame material, such that the protrusion 217 and the locking bar 222 may deform in response to contact at their interface and forces at that interface from abutting contact of edges of the upper material 203 of joined boards.

Figure 15:
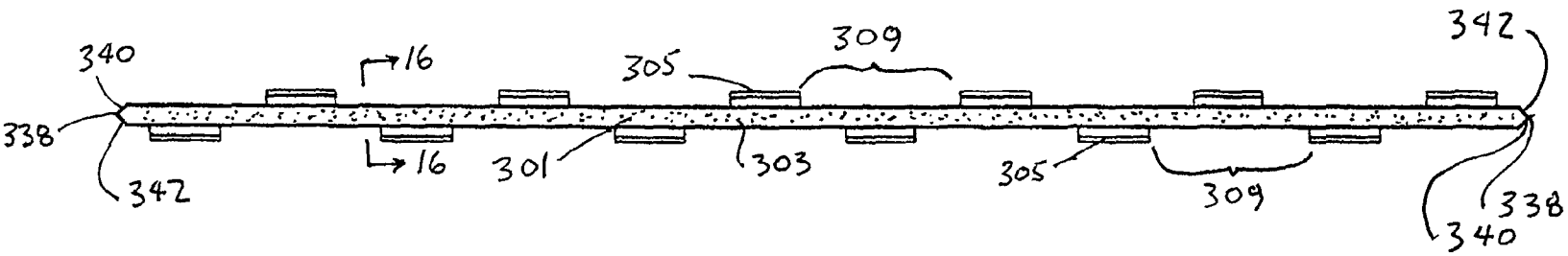
FIG. 15 is a plan view of a strip comprising a fourth embodiment.
Figure 16:
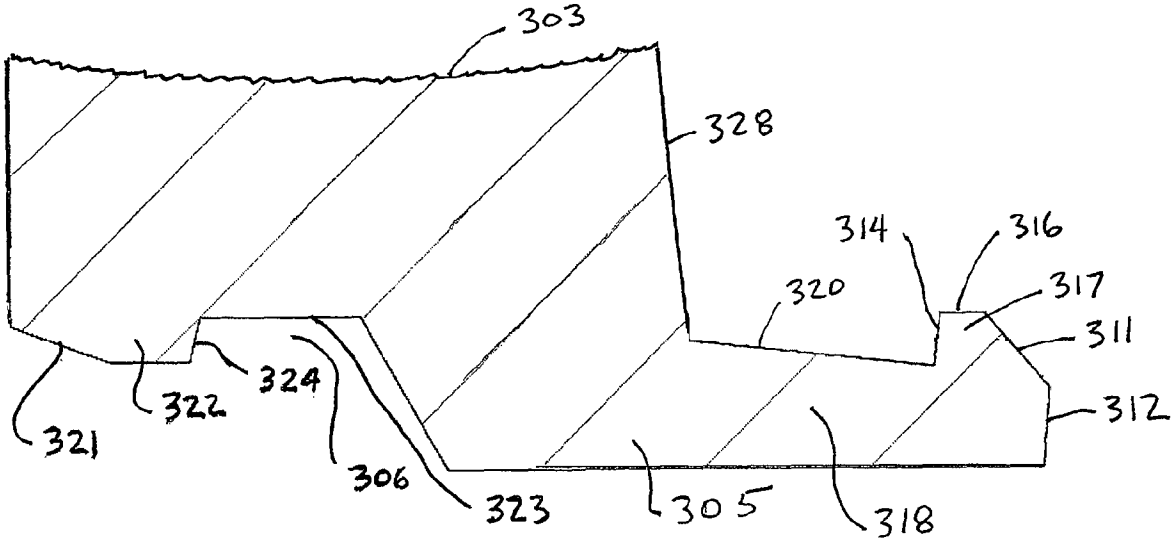
FIG. 16 is a sectional view of the strip shown in FIG. 15 taken along line 16-16 in FIG. 15.

FIGS. 15 and 16 show components of a fourth embodiment. In describing the fourth embodiment, three-digit reference numerals in the three hundreds are used. Where structures similar to earlier-described embodiments are present in the third embodiment, the tens digit and units digit of the reference numerals are chosen to correspond to the two digit reference numerals used to describe the first and second embodiments.

FIGS. 15 and 16 show a locking strip 308 that may be used to provide a decorative area between boards 208. The strip is suitable for use with boards 208 have upper materials 203 made to have the look of ceramic tile or stone or that have actual ceramic tile or stone. The upper surface 303 of the strip 308 is concave and rough to have the appearance of mortar joint, and the plastic used to form the strip (e.g., high impact polystyrene or other plastic) may be molded with a colorant to be provide additional decorative or realistic appearance. The ends of the strip 301 have pointed tips 338, formed by angled surfaces 340 and 342 disposed at about 90 degrees, such that at a corner where four boards meet, and four strips 301 converge, the appearance of gaps at such points of convergence will be minimized.

The strip 301 has tongues 305 separated by spaces 309, and the underside of the strip 301 has locking bars 322 and recesses 306 between the tongues 305, and the tongues 305, bars 332 and recesses 306 have a configuration that matches with and connect to similar tongues 205 and locking bars 222 at the edges of boards 208. As with a full-sized board 208, the strip 308 has a tongue 305 with a protrusion 317 and an intermediate section 318 with an upper surface 320. The protrusion 317 has a locking surface 314, a generally flat top surface 316, beveled nose 311, and blunt tip 312. Above the tongue is a face 328 below the upper edge of the strip. The strip locking has spaces 309 between tongues 305, and recesses 306 and locking bars 322 on its underside. The locking bar has a beveled guide surface 321 and locking surface 324. The recess 306 is bounded by the locking surface 324 and by a top surface 323, which is generally flat. The recess 306 is adapted to receive the tongue 205 of a board 208, as an adjacent board would.

The inventions discussed above have been described with respect to some specific examples of structure and materials, including LVT or other vinyl sheet, carpet and HPL (high pressure laminate), direct pressure laminate, ceramic tile, needle felt, wood, paper, printed or non-printed plastic material) for the upper material, and vinyl sheet, PVC (poly vinyl chloride) foam or EVA (ethylene-vinyl acetate), foamed EVA, TPE (thermoplastic elastomers such as, but not limited to, ethylene-propylene-diene copolymers), polystyrene, polyester, polyamide, polyolefin (foamed or not foamed), all of them eventually consisting of different layers with different structures/build, for the filler board, and high impact polystyrene (HIPS), ABS (acrylonitrile butadiene styrene), PP (polypropylene), PE (polyethylene), PA (polyamide) for the frame material. With regard to the connection of the upper material, filler board and frame, the assemblies shown herein are joined by Scotch-Weld™ 30 water based neoprene adhesive, but other techniques, such as hotmelt, PA-hotmelt, reactive hotmelt, solvent based neoprene adhesives, other water based neoprene adhesives, solvent welding, heat welding, thermoforming and ultrasonic welding may be used, depending on the materials being joined. However, these materials are only examples and are not intended to limit the scope of the invention. Indeed, persons of skill in the art may select other materials that may be called for or suggested by a particular application or design objective. The invention is not limited to the above-described embodiments or by the accompanying drawings. On the contrary, such boards can be made in different materials, shapes and dimensions while still remaining within the scope of the inventions claimed below.

EXAMPLE

An embodiment of the floor board described herein was tested for its acoustic properties. The embodiment was of the design of the third embodiment as described above in relation to FIGS. 10-14—this is described as "Embodiment 3" in the results tables below. The frame in the Embodiment 3 tested was made of injection moulded high impact polystyrene, with all latch tongues integrally formed with the sides of the frame, and all recesses formed in the underside of the frame. The filler board was a sheet of non-foamed PVC having a 3.6 mm thickness, the same as the thickness of the frame. The upper material was that of a Luxury Vinyl Tile material, and had four layers of calendared PVC, the bottom two of which had been stretched and allowed to relax, each having the directionality of stretching at 90° to the other, the second-from-top layer being a printed PVC layer, and the top layer being a transparent wear PVC layer. Together, the four layers of calendared PVC had a total thickness of 2 mm. The top wear layer had a thickness of 0.3 mm. The acoustic test methodology and the test results are given below.

Test Methodology

In building acoustics, two different modes of sound transmission are known. The first one is sound reflected by a building element into the same room, also known as drum sound. The second one is the transmission of sound through a building element to an adjacent room.

For sound reflection or drum sound, a number of standards exist. A widely used standard is the EPLF021029-3 (European Producers of Laminate Flooring), version of 29 Oct. 2004. The measurement method is based on measurements with a standard tapping machine in a semi-anechoic room. The test sample is installed on a concrete floor and tested under load. Eight tapping positions and four microphone positions are used for the measurement.

Each measurement is performed versus a reference floor, delivered by EPLF. The sound pressure levels of both the reference floor and the test floor are measured using in the 250-6300 Hz spectrum.

The post-measurement calculation accounts for the loudness of the reflected sound, according to the psycho acoustical definition of loudness by Prof. Zwicker and expresses the result as a single value loudness N.

Loudness N is defined in ISO 532:1975 and is a standardized method to measure the perceived strength of sounds. The loudness concept includes the frequency dependence of the hearing system. The unit is sone. 1 sone corresponds with a 1 kHz tone at 40 dB. Loudness is a linear measure. A doubling of the sone values results in a doubling of the perceived loudness.

The four lowest measurements of each sample are averaged to come to a Nm value.

The difference between the reference floor and the test floor is calculated in % and gives the reduction in loudness.

Depending on the percentage reduction compared to the reference floor, the tested floor is classified in classes SL0 to SL60 or higher, having reductions of

| Class | Reduction in % |
|---|---|
| $S_{L0}$ | Reduction less than 5% |
| $S_{L10}$ | Greater or equal to 5, less than 15% |
| $S_{L20}$ | Greater or equal to 15, less than 25% |
| $S_{L30}$ | Greater or equal to 25, less than 35% |
| $S_{L40}$ | Greater or equal to 35, less than 45% |
| $S_{L50}$ | Greater or equal to 45, less than 55% |
| $S_{L60}$ | Greater or equal to 55, less than 65% |

Test Results

A number of constructions were tested, with the following results:

| Flooring type | Description | Sound level (Nm) | SL level | Reduction (N) |
|---|---|---|---|---|
| 1. Reference | EPLF reference floor, DPL laminate with HDF carrier on an extruded non-crosslinked PE foam underlayment, 3 mm thick, 25 +/− 5 kg/m$^2$ | 73 | ref | — |
| 2. Laminate | 8 mm laminate floor on HDF | 57 | SL20 | 16 |
| 3. Laminate + PP foam | 8 mm laminate floor on HDF, on an extruded non-crosslinked PE foam underlayment, 3 mm thick, 25 +/− 5 kg/m$^2$; 186 × 1285 × 8 mm | 58 | SL20 | 15 |
| 4. Cushion vinyl | 2.8 mm cushion vinyl product, 0.35 mm wear layer, 4 m wide | 13 | SL80 | 60 |
| 5. Classic click LVT on PP foam | A profiled click LVT; 8 mm thickness on an extruded non-crosslinked PE foam underlayment, 3 mm thick, 25 +/− 5 kg/m$^2$ | 34 | SL60 | 39 |
| 6. Embodiment 3 | See above for details | 28 | SL60 | 45 |

Flooring types 1 to 5 in the table above represent commercially available flooring, tested for comparison purposes. Unexpectedly Embodiment 3, performed better than all conventional LVT products tested. Furthermore, it outperforms the laminate floors test, even when these are installed over 2.5 mm PP underlayment foam.

The walking noise (drum sound/reflected sound) of embodiments described in this application is clearly advantageous.

For sound transmission, also known as contact sound, a widely used standard is ISO 140-6:1998, ISO 140-8:1997 with references to ISO 140-1:1997, ISO 140-2:1991, ISO 717-2:1996 and EN 5079:1990. This family of standards describes how to measure the sound transmission to adjacent rooms through building elements.

In short, the measurement is done as follows:

A 140 mm concrete floor (reference floor) is fitted with the sample floor

Located under this floor is the receiving room.

The sound is made with a standard hammering machine, as described in ISO140-6 Annex A.

Measurements are taken on five different positions on the sample floor AND on the reference floor.

For measuring, a rotating microphone is used and measurements are filtered in terz bands. Thus resulting in time and space averaging of the signal.

The contact sound level Ln is calculated as follows:

$$Ln=Li+10\log(A/A_0) \text{ in dB}$$

Where:

Li is the sound pressure level per terz band in the receiving room, in dB;

A0 is the reference surface (in $m^2$)

A is the equivalent absorbing surface of the receiving room (in $m^2$)

The contact sound improvement $\Delta L_w$ is then expressed as the difference between the sound pressure level on the reference floor versus the test floor (in dB). For some standard flooring qualities, the following results were obtained:

| Flooring type | Description | $\Delta L_W$ (dB) |
|---|---|---|
| 1. Laminate + PP foam | 8 mm laminate floor on HDF, on an extruded non-crosslinked PE foam underlayment, 3 mm thick, 25 +/− 5 kg/$m^2$; 186 × 1285 × 8 mm | 23 |
| 2. Classic click LVT | A profiled click LVT; 8 mm thickness | 6 |
| 3. Classic click LVT on PP foam | A profiled click LVT; 8 mm thickness on an extruded non-crosslinked PE foam underlayment, 3 mm thick, 25 +/− 5 kg/$m^2$ | 23 |
| 4. Embodiment 3 | See above for details | 8 |
| 5. Embodiment 3 on PP foam | Embodiment 3 (see above for details) on an extruded non-crosslinked PE foam underlayment, 3 mm thick, 25 +/− 5 kg/$m^2$ | 23 |

The following conclusions can be drawn:

Embodiment 3 outperformed a conventional LVT when used without underlayment (it should be noted that the decibel scale is logarithmic)

Embodiment 3 had an equal performance as other flooring types when used in conjunction with an underlayment.

The general conclusion from the acoustics study described above is that embodiments of the present invention perform as well as or better than laminate floor coverings for the drum sound/walking noise test and has an equal performance in the sound transmission test.

The above Examples clearly show the advantages provided by embodiments of the invention which consist not only in a very good level of acoustic insulation, but also any of an improvement in conformability, an ease of laying, and the ability to assemble in different patterns.

The invention claimed is:

1. A board comprising a frame, an upper material and a filler board; the upper material having an exposed upper face and an underside, the filler board being disposed within a space defined by the frame; the underside of the upper material being attached to an upper surface of the frame; the underside of the upper material being attached to an upper surface of the filler board; the frame having a plurality of latch tongues extending outwardly from the frame; the frame having at least one recess formed in its underside for engaging at least one latch tongue, the latch tongues and the at least one recess of each board being arranged to allow engagement of the tongues of a first board with the recess of a second adjacent board wherein the board is square or rectangular in shape and said upper material is a resilient vinyl sheet, the sheet being slightly larger in both its longitudinal and lateral directions, so as to form a slight overhang beyond the underlying frame, the overhang being resiliently deformable to form a seal between joined boards.

2. The board of claim 1 wherein the board is a four-sided and generally square or rectangular floor board; latch tongues along one side of the frame being located at positions that are staggered with respect to the locations of latch tongues on an opposite side of the frame; each latch tongue on the frame having a width, and each of the tongues being separated from an adjacent latch tongue by a minimum space, the minimum space between latch tongues on the frame being at least as wide as the widest latch tongue on a frame, such that any side of a board may be connected to any side of another board of a substantially similar configuration.

3. The board of claim 1 wherein the latch tongues on a board have generally the same width, and spaces between tongues on opposite sides of a frame are generally uniform, the spaces being substantially greater in width than the width of the tongues on said opposite sides.

4. The board of claim 3 wherein the board is oblong and has opposite long sides and opposite short sides, each of the long and short sides having a plurality of latch tongues separated by spaces; recesses being formed on the underside of the frame inward of an edge of the board at locations corresponding to the spaces; beveled surfaces being formed on outer edges of the frame in areas between the latch tongues corresponding to the spaces, and the latch tongues having beveled nose surfaces, such that joining of one board to another can be done by slide-snapping board while they are substantially co-planar, whereby a beveled surface on the edges of the frame of a board is adapted to contact the beveled nose surface of a latch tongue of another similar board and facilitate the tongue passing along and under the beveled surface of the beveled surface of the edge into a recess on the underside of the frame.

5. The board of claim 4 wherein each of the latch tongues on the frame has an upward protrusion on a distal side of the tongue, one side of the protrusion forming at least a portion of the beveled nose surface, another generally inwardly facing side of the protrusion defining a locking surface for engagement with a generally inwardly facing locking surface of the recess of an adjacent board, the protrusion having a generally flat upwardly facing surface joining the beveled surface and the inwardly facing surface, the upwardly facing surface adapted to bear against a generally downwardly facing surface in the recess formed in the underside of an adjacent board, each of the tongues having an intermediate section having a generally flat upwardly facing surface extending outwardly of the edge of the frame, the upwardly facing surface of the intermediate section adapted to receive and abut a downwardly extending locking bar disposed inward of the edge of an adjacent board between tongues of the adjacent board.

6. The board of claim 1 wherein the upper material is selected from the group consisting of: a vinyl sheet, carpet, high pressure laminate, direct pressure laminate, and ceramic tile needle felt, wood, paper, printed or non-printed plastic material.

7. The board of claim 1 wherein the filler board is selected from the group consisting of: a vinyl sheet, PVC, EVA, TPE, polystyrene, polyester, polyamide, polyolefin, all of them foamed or not foamed, all of them eventually consisting of different layers with different structures/build.

8. The board of claim 1 wherein the upper surface of the frame is substantially flat and smooth, and the underside of the frame is comprised of ribs to minimize the area of contact and the transmission of sound from the board to a supporting structure.

9. The board of claim 1 wherein the frame is made of an injection molded plastic selected from the group consisting of: high impact polystyrene, ABS, PP, PE, PA polycarbonate, polystyrene, and polyvinyl chloride.

10. The board of claim 1 wherein the filler board and the frame are affixed to the underside of the upper material by a connection selected from the group consisting of hotmelt, PA-hotmelt, reactive hotmelt, solvent based neoprene, water based neoprene, solvent welding, heat welding, thermoforming and ultrasonic welding.

11. The board of claim 1, wherein the board has an acoustic characteristic better than a reduction of 30% in accordance with EPLF021029-3, version of 29 Oct. 2004.

12. The board of claim 1, wherein the board has an acoustic characteristic better than a reduction of 40% in accordance with EPLF021029-3, version of 29 Oct. 2004.

13. The floor board of claim 1 wherein tongues along one side of the board are staggered with respect to tongues disposed on an opposite side of the board, such that tongues on one side of the board align entirely within spaces on the opposite side of the board.

14. The board of claim 1 wherein the tongues of the board have beveled noses, and the edges of the board at locations corresponding to the spaces have beveled surfaces, and the width of the spaces is substantially greater than the width of the tongues, such that the board when joined along one of its sides to a second board having tongues and spaces arranged in configuration substantially similar to the board is adapted to be displaced in the direction of its joined edge and is adapted to snappingly connect a side of the board perpendicular to the joined side to third board having tongues and spaces arranged in a configuration substantially similar to configuration of the tongues and spaces of the board.

15. The board of claim 2, wherein the spaces are at least 1.5 times the width of the tongues.

16. The board of claim 2, wherein the spaces are at least 2 times the width of the tongues.

17. The board of claim 2, where the tongues are square or rectangular when viewed from above the board.

18. An assembly of boards, each board comprising a frame, an upper material and a filler board; the upper material having an exposed upper face and an underside, the filler board being disposed within a space defined by the frame; the underside of the upper material being attached to an upper surface of the frame; the underside of the upper material being attached to an upper surface of the filler board; the frame having a plurality of latch tongues extending outwardly from the frame; the frame having at least one recess formed in its underside, an outer side of the recess being bounded by a locking bar for engaging at least one latch tongue, the latch tongues and the locking bar of each board being arranged to allow engagement of the tongues of a first board with the recess of a second adjacent board, the upper material having edges that form overhanging portions that extend beyond the upper edges of the frame wherein the boards are floor boards and the upper material is a vinyl sheet, the latch tongue having a first locking surface, the locking bar having a second locking surface, the frames having upper surfaces with upper outer edges, two joined boards defining a distance W between the upper edges of the frames of joined boards when a first locking surface of one board is in contact with a second locking surface of an adjacent board, the vinyl sheet of each board having an overhanging portion extending outwardly beyond the upper edges of a frame to which the vinyl sheet is affixed, the overhanging portion having a lateral dimension H that is at least as large as half of the distance W.

19. The assembly of claim 18 wherein each of the boards has a frame with upper surfaces having upper outer edges, two joined boards defining said distance W between the upper edges of the frames of joined boards when a first locking surface of one board is in contact with a second locking surface of an adjacent board, the upper material of each board having said overhanging portion extending outwardly beyond the upper edges of a frame to which upper material is affixed, the overhanging portion having a lateral dimension H that has a lateral dimensional relationship to distance W selected from the group consisting of: H is greater than half of W, and H is approximately equal to half of W.

20. An assembly of boards, each board comprising a frame, an upper material and a filler board; the upper material having an exposed upper face and an underside, the filler board being disposed within a space defined by the frame; the underside of the upper material being attached to an upper surface of the frame; the underside of the upper material being attached to an upper surface of the filler board; the frame having a plurality of latch tongues extending outwardly from the frame; the frame having at least one recess formed in its underside, an outer side of the recess being bounded by a locking bar for engaging at least one latch tongue, the latch tongues and the locking bar of each board being arranged to allow engagement of the tongues of a first board with the recess of a second adjacent board, the upper material having edges that form overhanging portions that extend beyond the upper edges of the frame wherein the assembly includes a strip interposed between the edges of at least two boards, the strip having tongues along opposing longitudinal sides, the tongues being separated by spaces, at each space the strip has a locking bar defining one boundary of a recess into which the tongue of a board is adapted to fit.

21. The assembly of claim 20 wherein the ends of the strip have two beveled edges forming a generally right angle defining a pointed tip.

22. A four-sided board having a plurality of latch tongues on each side extending outwardly from the board, each latch tongue having an upwardly extending projection; the board having at least one locking bar located on its underside for engaging the upwardly extending projection of at least one of the latch tongues; wherein the latch tongues along each side of the frame are located at positions that are staggered with respect to the locations of latch tongues on an opposite side of the frame; each latch tongue on the board having a width, and each of the latch tongues being separated from an adjacent latch tongue on the same side by a minimum space, the minimum space between latch tongues on the board being at least as wide as the widest latch tongue on a board, such that any side of a board may be connected to any side of another board of the same configuration wherein the locking bar forms part of a recess in the form of a continuous groove formed in the underside of the board, the groove running alongside and parallel to each of the four edges of the board.

23. The board of claim 22, the board comprising a frame, an upper material and a filler board; the upper material having an exposed upper face and an underside, the filler board being disposed within a space defined by the frame; the underside of the upper material being attached to an upper surface of the frame; the underside of the upper material being attached to an upper surface of the filler board; the latch tongues extending outwardly from the frame; the locking bar forming part of at least one recess formed in the underside of the frame for engaging at least one latch tongue.

24. The board of claim 22, wherein the latch tongues on the board have generally the same width, and spaces between tongues on opposite sides of a frame are generally uniform, the spaces being greater in width than the width of the tongues on said opposite sides.

25. The board of claim 22, wherein, when engaged with a board of the same configuration, such that the latch tongues on one board have engaged with the at least one locking bar of the other board, and one board is slidably movable relative to the other board in the direction of the edges of the engaged boards.

26. The board of claim 22 wherein each of the latch tongues has the upwardly extending projection on a distal side of the tongue, one side of the projection forming at least a portion of a beveled nose surface, another generally inwardly facing side of the projection defining a locking surface for engagement with a generally inwardly facing locking surface of the at least one locking bar.

* * * * *